United States Patent [19]

Schimmel

[11] 4,423,682

[45] Jan. 3, 1984

[54] ONE-WAY EXPLOSIVE TRANSFER ASSEMBLY

[75] Inventor: Morry L. Schimmel, University City, Mo.

[73] Assignee: McDonnell Douglas Corporation, St. Louis, Mo.

[21] Appl. No.: 311,079

[22] Filed: Oct. 13, 1981

[51] Int. Cl.[3] ..... F42B 3/10

[52] U.S. Cl. ..... 102/275.2; 89/1 B

[58] Field of Search ..... 102/275.2, 275.1, 275.3, 102/275.7, 275.8; 89/1 B

[56] References Cited

U.S. PATENT DOCUMENTS

| | | | |
|---|---|---|---|
| 3,169,480 | 2/1965 | Seavey | 102/275.2 |
| 3,320,884 | 5/1967 | Kowalick et al. | 102/275.3 |
| 3,326,127 | 6/1967 | Schimmel | 102/275.2 |
| 3,368,485 | 2/1968 | Klotz | 102/275.2 |
| 3,460,477 | 8/1969 | Heidemann et al. | 102/275.2 |

*Primary Examiner*—David H. Brown

*Attorney, Agent, or Firm*—Gravely, Lieder & Woodruff

[57] ABSTRACT

A one-way explosive transfer assembly embodying a body formed with an interior chamber containing an explosive shock transfer body formed with shock wave attenuating passage means shaped to transfer heat and to control the explosive shock when traveling in one direction toward an explosive train and to check explosive shock if generated to travel in an opposite direction. The assembly includes an input shielded mild detonating cord means for conveying the triggering impulse to the explosive train and for transferring the effect of the explosive train to an output shielded mild detonating cord.

9 Claims, 2 Drawing Figures

ONE-WAY EXPLOSIVE TRANSFER ASSEMBLY

BACKGROUND OF THE INVENTION

1. Field of the Invention

This invention pertains to a one-way explosive transfer assembly which is useful in military aircraft escape systems.

2. Description of the Prior Art

The one-way explosive transfer assembly is known in U.S. Pat. Nos. 3,326,127 and 3,460,477. U.S. Pat. No. 3,326,127 of Schimmel, issued June 20, 1967, is directed to a one-way explosive connector device having internal angled bores, and each bore receiving an explosive device, because the angled relationship is positioned so that only one of the bores intersects with the other. In this device the out-of-line explosive device, if set off, projects its shrapnel charge so that it will be dissipated in the end of the angled bore. The opposite in-line explosive device, when set off, will direct its shrapnel charge so as to pass the detonation effect through the device. The detonation effect is produced by fragmentation of a component which creates the shrapnel effect. The U.S. Pat. No. 3,460,477 of Heideman et al which issued Aug. 12, 1969, is a one-way detonation transfer device having a fixed wall separating the acceptor charge and the donor charge which are otherwise mounted in aligned opposing bores. One surface of the fixed wall between the bores is angularly formed so that any shock wave from the acceptor charge is dissipated to avoid detonating the donor charge.

A further one-way device is disclosed by Seavey in U.S. Pat. No. 3,169,480 of Feb. 16, 1965, and comprise a tubular housing with a detonating charge section and a baffle section defining a suitable air gap.

Another example of an explosive device is disclosed by Kowalick et al in U.S. Pat. No. 3,320,884 of May 23, 1967 where an igniter mixture receives adequate energy to ignite and vent hot gases through angled vent holes for igniting a delay composition. The Kowalick device is not strictly a one-way transfer of shock waves generated by explosive devices as the internal structure embodies opposing passages facing in opposite directions for the transfer and venting of hot gases which ignite the explosive composition deposed between the opposing vent passages.

Present designs of one-way transfer assemblies embody a shielded mild detonating cord (SMDC) end tip which actuates a firing pin to initiate detonation of a single primer which then ignites a standard explosive train to detonate the output shielded mild detonating cord. Such a device is truly a one-way transfer because of the blocking effect of the primer and firing pin.

SUMMARY OF THE INVENTION

This invention embodies a unique assembly which overcomes certain problems associated with the single percussion primer currently in use. It is known that percussion primers are so low cost that quality control is limited by the makers. In the current devices the primers are considered the limiting item in the service life of such assemblies.

The objects of the present invention are to overcome the problems of prior transfer assemblies, to provide a unique transfer assembly having no moving parts, to eliminate the need for firing pins and primers, to provide a transfer assembly which can use hermetically sealed and qualified explosive train means, and to provide a transfer assembly which permits retrofitting and can make use of existing hardware.

A preferred embodiment employs a body of two main parts, an internal transfer assembly having angled gas ports and protective diaphragms associated one with the gas ports and one with an explosive train. This embodiment is provided with an input shielded mild detonating cord (SMDC) at one end and a similar SMDC at the output end.

BRIEF DESCRIPTION OF THE DRAWINGS

The presently preferred embodiment of the transfer assembly is illustrated in the accompanying drawing, wherein.

DETAILED DESCRIPTION OF THE EMBODIMENT

Figure 1:
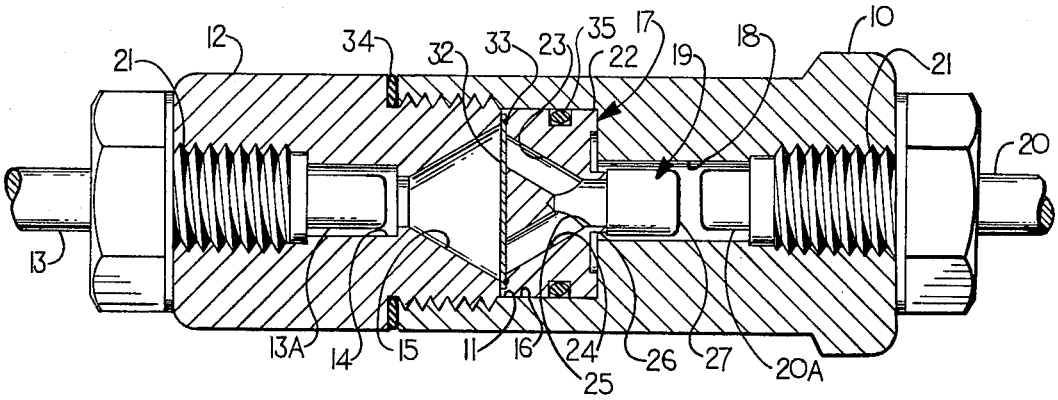
FIG. 1 is a longitudinal sectional view of a complete showing of the components making up the unique one-way transfer assembly.

Referring to FIG. 1, the one-way explosive transfer assembly consists of a primary body or housing 10 counterbore at 11 and threaded to receive a cap or head 12 received in the counterbore. The head 12 positions the input shielded mild detonating cord 13 in final position, and is formed with a passage 14 to receive the cord. The inner end of that head passage 14 is flared or expanded at 15 for a purpose to appear.

The counterbore 11 in the housing 10 is extended beyond the flared or expanded end 15 of the passage 14. The cylindrical portion of the counterbore 11 beyond the latter end 15 provides a chamber 16 which includes the space formed in the end to receive a transfer assembly 17 which is seen in greater detail in FIG. 2. The housing 10 is further formed with a small bore 18 which continues beyond the chamber 16 for the transfer assembly 17 to receive an explosive train 19 positioned adjacent and/or carried by the transfer assembly 17. That small bore 18 also receives a shielded mild detonating cord 20. A retainer 21 in the housing 10 is employed to keep the tip 20A of cord 20 in place, just as a similar retainer 21 is employed in the head 12 to keep the tip 13A of cord 13 in place.

Figure 2:
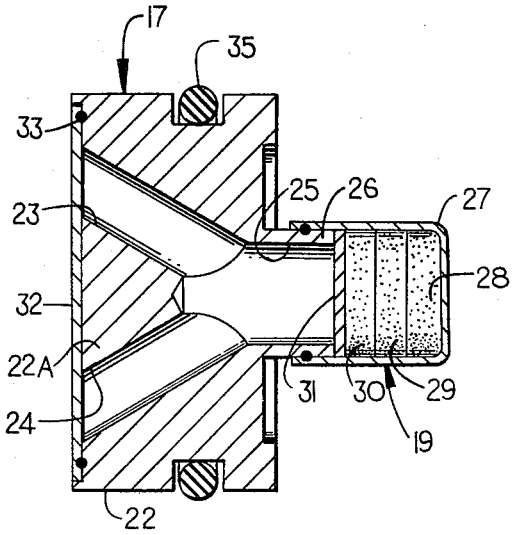
FIG. 2 is a somewhat enlarged detail in partial section of the internal transfer and explosive train.

Turning now to FIG. 2 of the drawings, there is shown in an enlarged size the transfer assembly 17 which includes a body 22 formed with passage means, such as a pair of passages 23 and 24 angularly related so as to converge and join at a common passage 25, and a shock attenuating means 22A in line with the input tip 13A of the cord 13. The body passage 25 continues into an extension 26 for the body 22 which cooperates with a cap 27 carrying an explosive charge to form the explosive train 19. The cap 27 is welded or otherwise secured to the extension 26, and is loaded or charged with a body 28 of hexanitrostilbene, a body 29 of lead azide and a body 30 of lead styphnate. The contents of the cap 27 is closed by a thin diaphragm 31 formed of stainless steel and is placed over the lead styphnate body 30 for environmental protection prior to welding the cap 27 to the extension 26. It can be seen in FIG. 2 that the divergent passages 23 and 24 are closed by a diaphragm 32 which is secured in position by a continuous pheripheral weldment 33. The diaphragm 32 is formed of thin steel and is utilized to protect the explosive train from moisture, but rupture to pass heat.

While the body 22 is shown with passage means 23 and 24 joining at a common passage 25 and a shock attenuating means 22A which stops the shrapnel or fragments from the tip 13A traveling toward the explosive train 19, other configurations of passage means and shock and shrapnel attenuating means may be used. For example, a single non-straight passage and a shock attenuating means at the entrance will function to allow heat to propagate toward the explosive train 19 but attenuate the shock wave and prevent shrapnel impact effect on the train 19.

Referring again to FIG. 1 it is to be understood that the one-way explosive reaction moves from left to right in that view, while the "no-fire" direction takes place in the opposite direction if the output tip 20A of the shielded mild detonating cord 20 is initiated. When this happens the brisance of the detonation will be dissipated because of the shock attenuating portion 22A and damage or burn of the tip 13A of the input shielded mild detonating cord 13 will be prevented. However, tests have shown that the heat input in such an event can not detonate cord 13.

It can be observed without difficulty that the present unique one-way explosive transfer assembly has no moving parts, makes use of the heat output of the explosive cord tip 13A while protecting against its brisance, and the housing for the explosive components is a simple body which has threadedly united components provided with a suitable seal 34 between the two parts and with an internal seal 35 at the transfer assembly 17. In the presently preferred embodiment the explosive transfer assembly takes the form of a body having an inlet passage 14 and an outlet passage 18, a first detonating cord 13 received in the body inlet passage, a second detonating cord 20 received in the body outlet passage, an explosive train positioned adjacent the second detonating cord so as to be in explosive initiating association with such a cord, heat transfer passage means in the body between the first detonating cord and the explosive train, and shock attenuating means in the body positioned so that it will function to block the travel of fragments from the first detonating cord toward the explosive train through the heat transfer passage means.

In tests in the "go" direction at temperatures of 70° F. to minus 65° F., the function time between input and output was of the order of 1.0 millisecond. In the "no go" direction the SMDC tip 13A was completely burned, but the detonating cord in contact with the tip was undamaged.

I claim:

1. In a one-way explosive transfer assembly, the improvement comprising:

(a) a body formed with spaced passages opening outwardly of the body:

(b) a first detonating cord mounted in one of said passages, said first cord having an explosive tip within said body;

(c) a second detonating cord mounted in another one of said passages, said second cord having an explosive tip within said body spaced from said first cord explosive tip;

(d) heat transfer passage means in said body in communication between said spaced passages;

(e) an explosive train disposed in said heat transfer passage means so as to be adjacent said second detonating cord explosive tip; and (f) shock attenuating means in said body between said first cord explosive tip and said explosive train, said shock attenuating means blocking the travel of explosively projected fragments between said first cord explosive tip and said explosive train while permitting the travel of heat through said heat transfer passage means for detonating said explosive train to initiate the detonation of said second detonating cord at said explosive tip.

2. The improvement set forth in claim 1 wherein said explosive train disposed in said heat transfer passage means is mounted in a container in alignment with said second detonating cord.

3. The improvement set forth in claim 1 wherein said heat transfer passage means is in off-set alignment relative to said one of said body passages, and said shock attenuating means is positioned in said body to be in the path of shrapnel fragments from said explosive tip on said first detonating cord.

4. The improvement set forth in claim 1 wherein said heat transfer passage means comprises passage portions having heat receiving ends in spaced relation and being directed to a common outlet end directed at said explosive train, said receiving ends of said pair of passage portions being out of alignment with said one of said body passages.

5. The improvement set forth in claim 4 wherein said shock attenuating means is disposed relative to said receiving ends of said passage portions and said first detonating cord explosive tip for blocking travel of explosive fragments through said heat transfer passage portions.

6. In a one-way explosive transfer assembly, the improvement comprising:

(a) a body formed with an internal chamber and bores oppositely directed and opening outwardly of said body from said chamber;

(b) a heat transfer assembly disposed in said chamber and formed with an opening facing into one outwardly opening bore and heat transfer passage means directed away from said opening toward the other outwardly opening bore;

(c) an explosive initiating means positioned adjacent said heat transfer assembly at said opening;

(d) a first detonating cord received in said body in one of said bores so as to approach said heat transfer assembly from said heat transfer passage means;

(e) a second detonation cord received in the other of said bores in said body so as to approach said explosive initiating means; and (f) means in said chamber in position for attenuating shock transfer toward said explosive initiating means upon detonation of said first detonating cord.

7. A one-way explosive transfer assembly comprising:

(a) a body having an internal chamber with first and second passages opening outwardly from said chamber;

(b) first detonating cord means in said first passage with a first explosive tip adjacent said chamber;

(c) second detonating cord means in said second passage with a second explosive tip spaced from said chamber;

(d) explosive initiating means in said chamber adjacent said second explosive tip; and (e) heat transfer means for the hot gases of the explosion disposed in said chamber between said first explosive tip and said explosive initiating means, said heat transfer means including shock attenuating means positioned to block travel of fragments from said first explosive tip toward said explosive initiating means.

8. The one-way explosive transfer assembly of claim 7 wherein diaphragm means is positioned between said heat transfer means and said explosive initiating means in the path of the hot gases of the explosion.

9. The one-way explosive transfer assembly of claim 7 wherein said heat transfer means is formed with passages separated by said shock attenuating means so the passages are out of direct alignment with said first explosive tip, and diaphragm means is disposed beyond said heat transfer means.

* * * * *